US006179626B1

(12) United States Patent
Wu

(10) Patent No.: US 6,179,626 B1
(45) Date of Patent: Jan. 30, 2001

(54) ELECTRICAL CONNECTION SYSTEM

(75) Inventor: Kun-Tsan Wu, Tu-Chen (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/330,256

(22) Filed: Jun. 10, 1999

(30) Foreign Application Priority Data

Nov. 17, 1998 (TW) ..... 87219011

(51) Int. Cl.[7] ..... H01R 9/09
(52) U.S. Cl. ..... 439/74; 439/289
(58) Field of Search ..... 439/74, 289

(56) References Cited

U.S. PATENT DOCUMENTS 5,055,054 * 10/1991 Doutrich ..... 439/66
5,306,163 * 4/1994 Asakawa ..... 439/74
5,499,924 * 3/1996 Arisaka et al. ..... 439/67
5,556,285 * 9/1996 Ono ..... 439/74
5,697,799 * 12/1997 Consoli et al. ..... 439/181
5,860,814 * 1/1999 Akama et al. ..... 439/74
5,885,092 * 3/1999 Ito et al. ..... 439/74
5,915,976 * 6/1999 McHugh ..... 439/74
5,964,594 * 10/1999 Saitoh et al. ..... 439/74
5,971,809 * 10/1999 Ho ..... 439/660

* cited by examiner

*Primary Examiner*—Steven L. Stephan
*Assistant Examiner*—Thanh-Tam Le
(74) *Attorney, Agent, or Firm*—Wei Te Chung

(57) ABSTRACT

An electrical connection system includes a plug connector and a socket connector mated with each other. The plug connector includes an insulative housing having a mating face defining a plurality of channels therein for each receiving a plug contact element. Each plug contact element includes a mating section extending along a first axis substantially normal to the mating face of the plug connector and having a tip portion extending beyond the mating face. The socket connector includes an insulative housing having a mating face defining a plurality of passageways therein corresponding in position to the channels of the plug connector. Each passageway has a socket contact element fixed therein. Each socket contact element includes a mating section located in the passageway and extending along a second axis substantially parallel to the mating face. The mating faces of the plug and socket connectors are overlappingly engageable with each other whereby the tip portions of the plug contact elements are inserted into the passageways and engage with the corresponding mating sections of the socket contact elements in a substantially perpendicular fashion.

16 Claims, 11 Drawing Sheets

ELECTRICAL CONNECTION SYSTEM

BACKGROUND OF THE INVENTION

1. Field of the Invention

The present invention generally relates to an electrical connection system comprising a socket connector and a plug connector mated with each other, and in particular to an electrical connection system wherein contacts of a plug connector are brought into engagement with contacts of a socket connector in a direction substantially normal thereto.

2. The Prior Art

An electrical connection system comprising a plug connector and a socket connector mating with each other is well known in the electronics field. Connectors of this type are disclosed in Taiwan patent application Nos. 84213256 and 85201191.

The plug connector and the socket connector both have contacts engageable with each other. Conventionally, the contacts of the plug and socket connectors engage with each other in a parallel fashion. In other words, the contacts of the plug connector and the contacts of the socket connector are substantially parallel to each other during the engagement process. To ensure proper engagement between the plug contact and the corresponding socket contact, at least one of the contacts forms a bent section. Furthermore, the relative position between each socket contact and the plug contact must be precise to obtain proper electrical engagement therebetween. Such precise positioning of the contacts in the connectors increases overall manufacturing costs and the likelihood of unstable electrical engagement.

It is thus desirable to have an electrical connection system wherein the contacts of the plug and socket connectors engage with each other in a perpendicular fashion.

SUMMARY OF THE INVENTION

Accordingly, an object of the present invention is to provide an electrical connection system comprising a plug connector and a socket connector mated with each other, contact elements of the plug and socket connectors engaging with each other in a perpendicular fashion.

Another object of the present invention is to provide an electrical connection system comprising a plug connector and a socket connector mated with each other, wherein no strict tolerance is required in order to ensure proper engagement between contact elements of the connectors.

To achieve the above objects, an electrical connection system in accordance with the present invention comprises a plug connector and a socket connector mated with each other. The plug connector comprises an insulative housing having a mating face defining a plurality of channels therein for receiving plug contact elements. Each plug contact element comprises a mating section extending along a first axis substantially normal to the mating face of the plug connector and having a tip portion extending beyond the mating face. The socket connector comprises an insulative housing having a mating face defining a plurality of passageways therein corresponding in position to the channels of the plug connector. Each passageway has a socket contact element fixed therein. Each socket contact element comprises a mating section located in the passageway and extending along a second axis substantially parallel to the mating face. The mating faces of the plug and socket connectors are overlappingly engageable with each other whereby the tip portions of the plug contact elements are inserted into the passageways and engage with the corresponding mating sections of the socket contact elements in a substantially perpendicular fashion.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENT

An electrical connection system in accordance with the present invention comprises a plug connector and a socket connector mating with each other. Both the plug connector and the socket connector comprise conductive contact elements engaged with each other when mating the plug and socket connectors together thereby establishing electrical connection therebetween. In the electrical connection system of the present invention, the contact elements of the plug connector are brought into contact with the contact elements of the socket connector in a direction substantially normal thereto. The contact elements of the plug connector are deflected from a substantially normal condition with respect to the contact elements of the plug connector thereby forming a point contact between each plug contact element and the corresponding socket contact element to a partially parallel condition wherein a surface contact is formed between the plug contact element and the socket contact element to ensure a firm contact engagement between.

Figure 1:
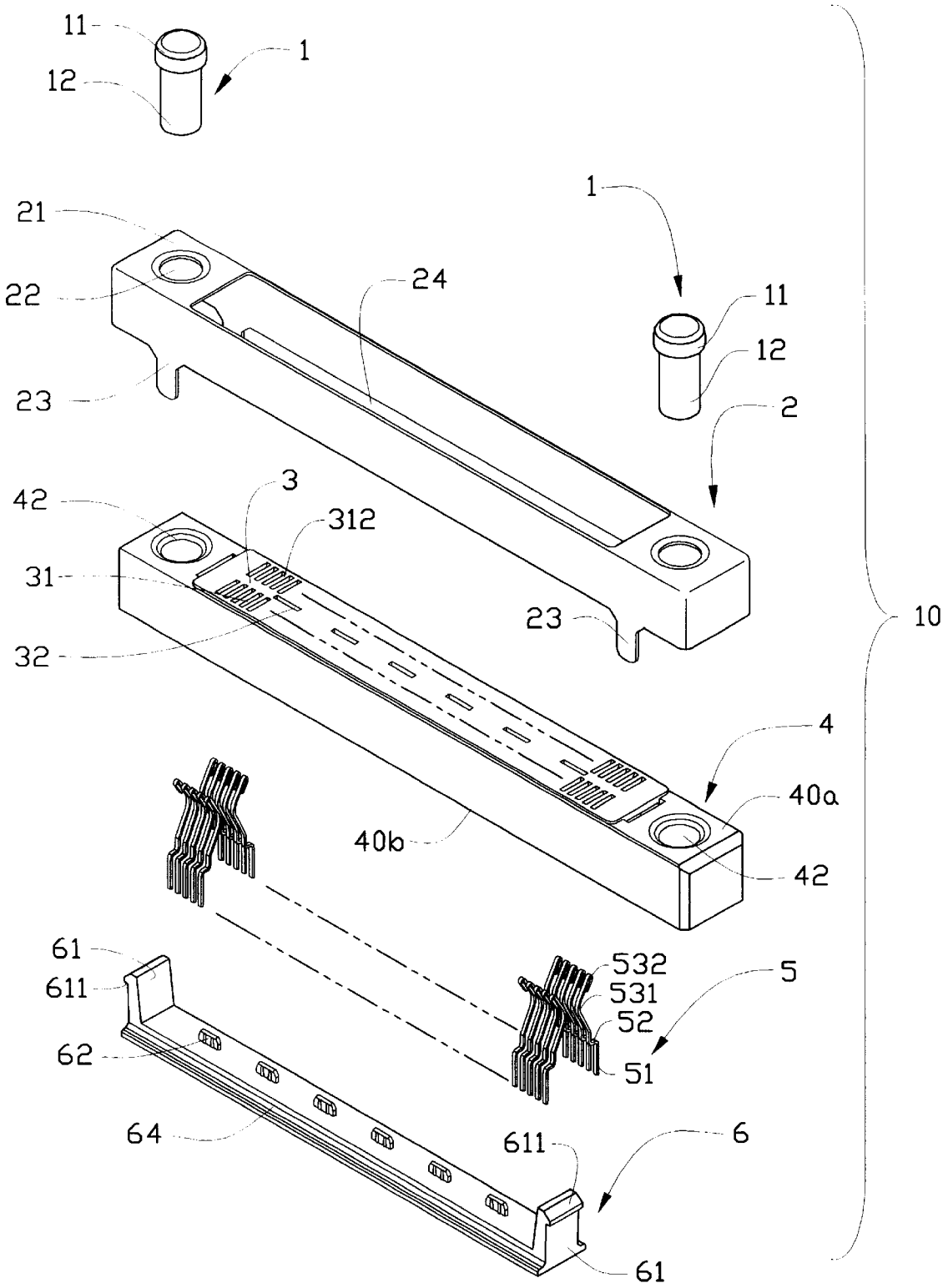
FIG. 1 is an exploded view of a plug connector of an electrical connection system in accordance with the present invention.
Figure 2:
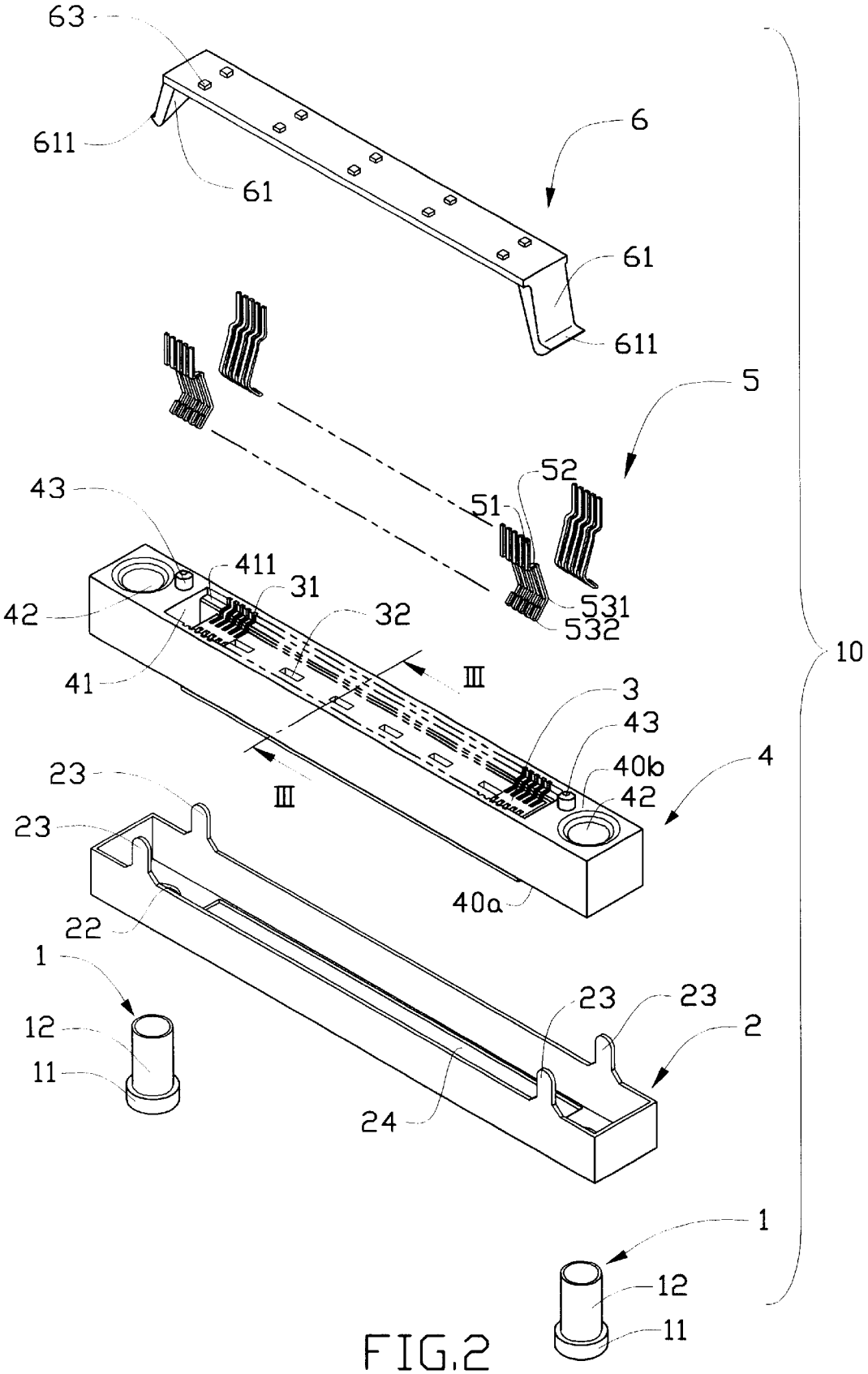
FIG. 2 is similar to FIG. 1 taken from a different perspective.

Referring now to the drawings and in particular to FIGS. 1 and 2, a plug connector in accordance with the present invention, generally designated by reference numeral 10, comprises an elongate insulative housing 4 having a mating face 40*a* and a mounting face 40*b* opposite the mating face 40*a*. The mounting face 40*b* defines a cavity 41 therein into which an insert 6 is inserted.

Figure 3:
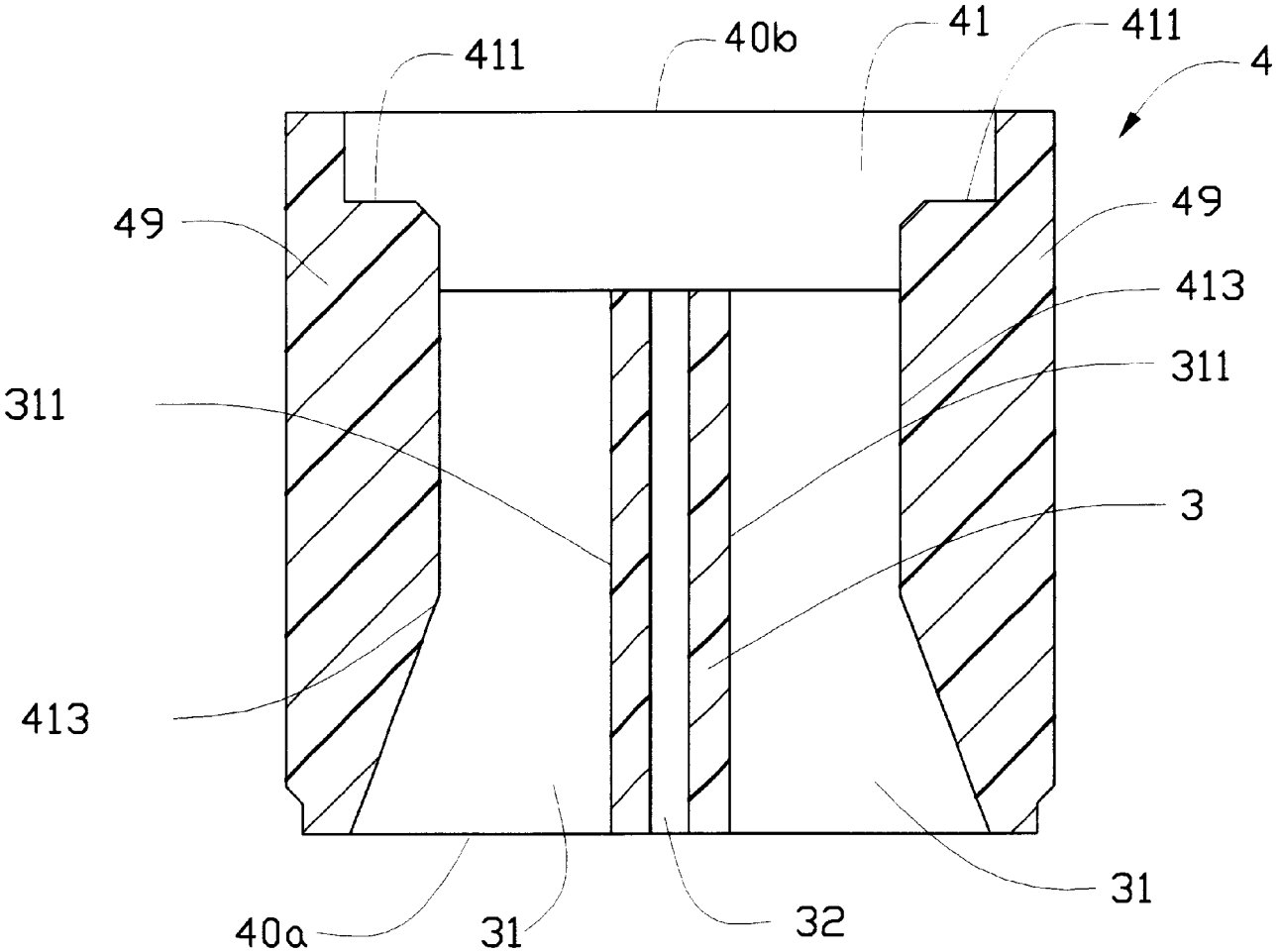
FIG. 3 is a cross-sectional view taken along line III—III of FIG. 2.
Figure 4:
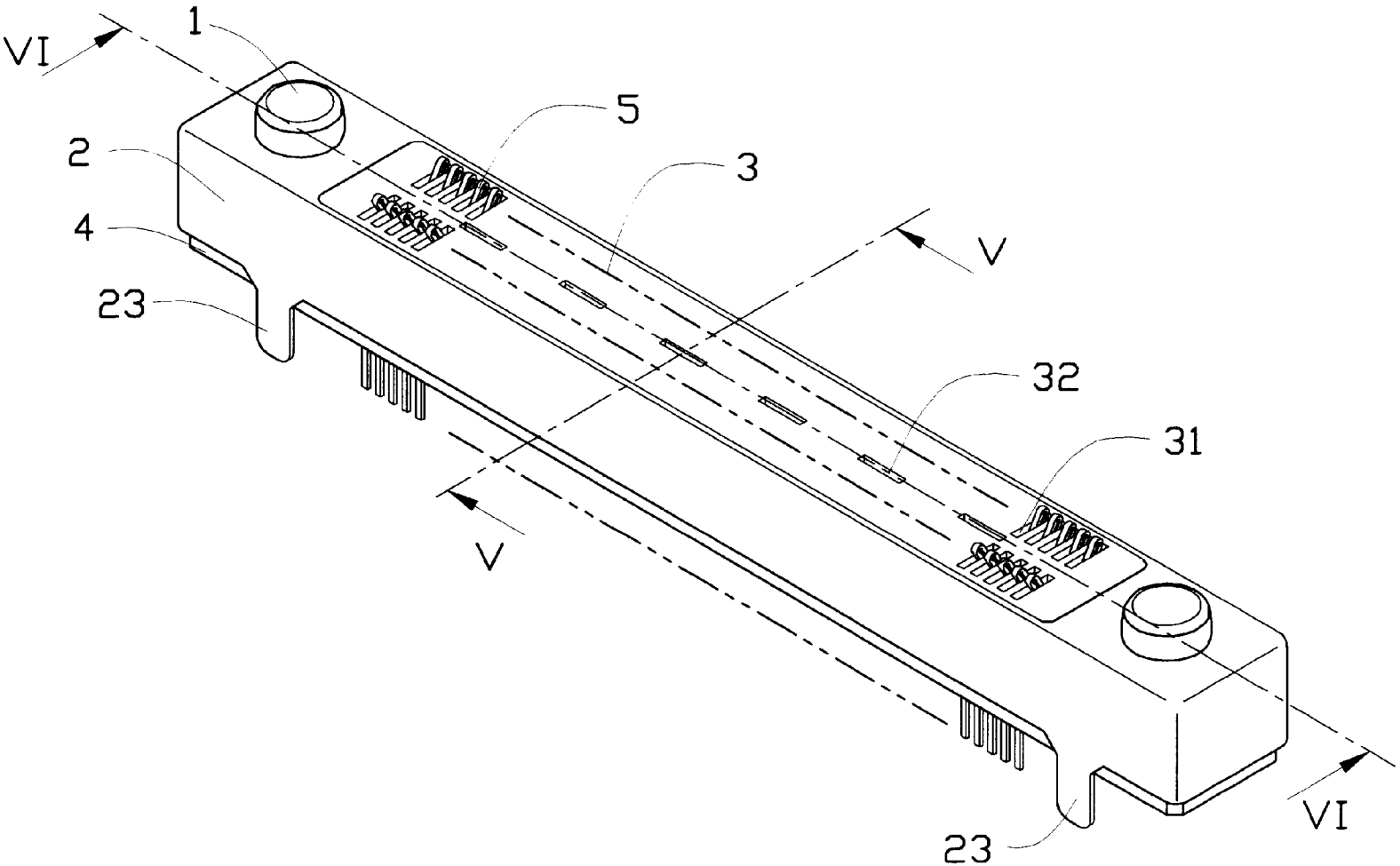
FIG. 4 is an assembled view of FIG. 1.

Also referring to FIGS. 3 and 4, the housing 4 defines a plurality of contact receiving channels 31 therein disposed in two rows in the longitudinal direction. The contact receiving channels 31 extend from the mating face 40*a* of the housing 4 to the cavity 41. A partition wall 312 is formed between adjacent contact receiving channels 31 of the same row. The two rows of contact receiving channels 31 are separated by an internal wall 3 of the housing 4 and bound by two side walls 49 of the housing 4. Each side wall 49 has an inside face 413.

The cavity 41 forms a shoulder 411 on each side wall 49 of the housing 4. A number of bores 32 are defined in the internal wall 3 communicating with the cavity 41 for receiving positioning pins 62 of the insert 6 therein, preferably in an interferential manner for securing the insert 6 in the cavity 41. The insert 6 further comprises two resilient arms 61 formed at opposite ends thereof, each arm 61 having a barb 611 engageable with an internal shoulder 44 (FIG. 6) formed inside the housing 4 for securing the insert 6 in the housing 4. The insert 6 also has a plurality of positioning projections 63 for positioning on a circuit board (not shown).

Figure 5:
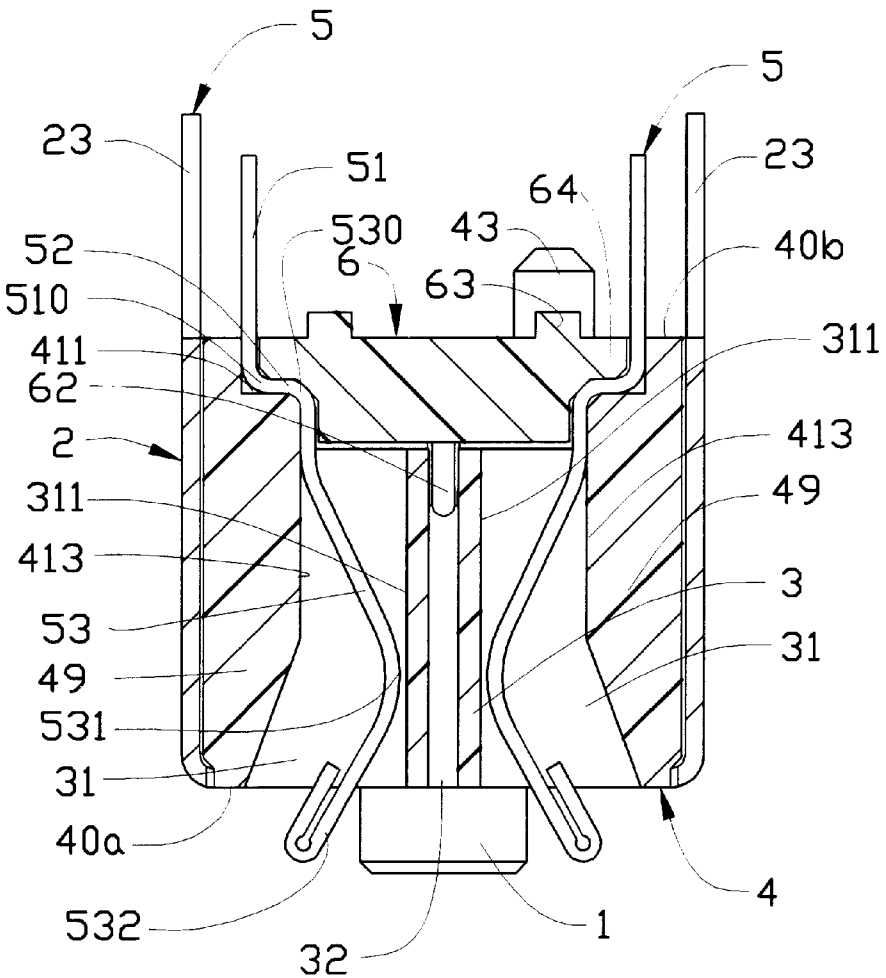
FIG. 5 is a cross-sectional view taken along line V—V of FIG. 4.

Each contact receiving channel 31 receives a plug contact element 5 therein. As shown in FIG. 5, each plug contact element 5 comprises a mating section 53 disposed in the corresponding contact receiving channel 31 and substantially extending along a first axis (not labeled) normal to the mating face 40*a* and a mounting section 51 extending beyond the mounting face 40*b* of the housing 4. A fixing section 52 is formed between the mating section 53 and the mounting section 51. The fixing section 52 forms a right-angled portion 530 at a junction with the mating section 53 and is supported on the shoulder 411 of the housing 4 with a portion of the mating section 53 supported by the inside face 413 of the side wall 49 of the housing 4. The insert 6 has a side flange 64 formed on each side thereof and extending above the shoulder 411 of the side wall 49 thereby overlapping and thus retaining the fixing section 52 in position.

In the embodiment illustrated, the fixing section 52 of each plug contact element 5 forms a right-angled portion 510 at a junction with the mounting section 51 which renders the mounting section 51 to be substantially parallel to the mating section 53. The right-angled portion 510 causes the mounting section 51 to extend in a direction substantially normal to the mounting face 40*b*.

The mating section 53 of each plug contact element 5 comprises a tip portion 532 extending beyond the mating face 40*a* and inclined with respect to the first axis which is normal to the mating face 40*a* and an arcuate portion 531 connecting the tip portion 532 to the fixing section 52 of the plug contact element 5. The arcuate portion 531 is convex with respect to the internal wall 3 of the housing 4 and an apex thereof is located proximate or abutting against a corresponding surface 311 of the internal wall 3 for providing resiliency that allows the tip portion 532 to be deflected toward the mating face 40*a*. When the tip portion 532 is deflected, the apex of the arcuate portion 531 is moved toward and abuts against the internal wall 3 for supporting the deflection of the tip portion 532.

A shield casing 2 has an open bottom fit over the housing 4 for surrounding the housing 4 (FIGS. 4 and 5). Grounding tabs 23 extend from the shield casing 2 for electrically grounding the shield casing 2. The shield casing 2 has a top wall 21 positioned on the mating face 40*a* of the housing 4. The top wall 21 of the shield casing 2 defines a central opening 24 for exposing the contact receiving channels 31.

Figure 6:
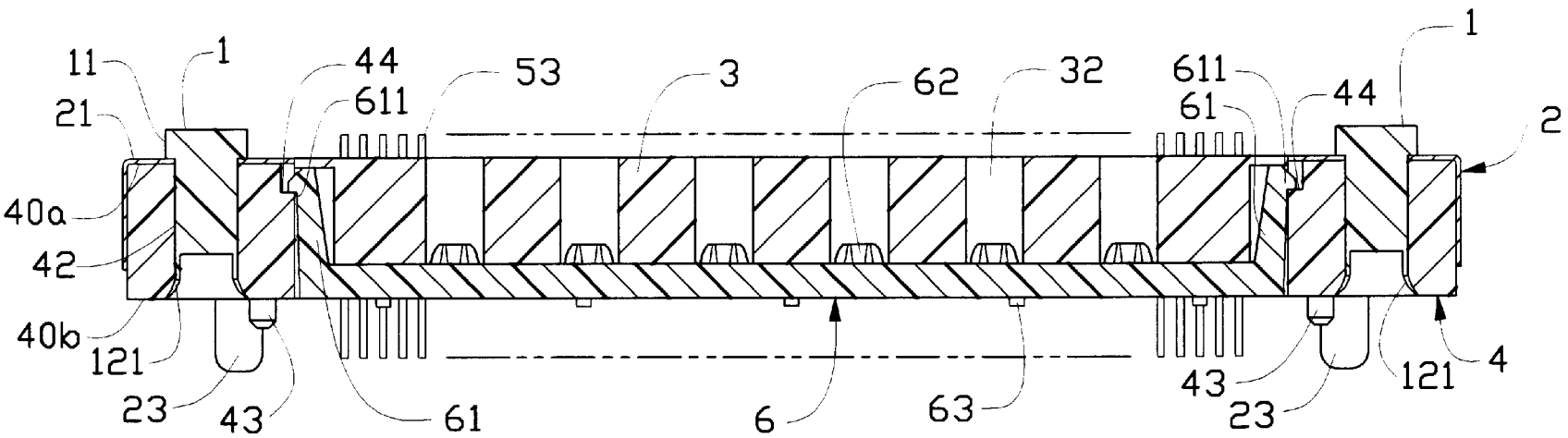
FIG. 6 is a cross-sectional view taken along line VI—VI of FIG. 4.

The top wall 21 of the shield casing 2 further defines two pin holes 22. Corresponding to each pin hole 22 of the shield casing 2, a bore 42 is defined in the housing 4. A guide post 1 has a post body 11 and a reduced pin section 12 inserted through the pin hole 22 and fit into the bore 42 with the post body 11 supported on the top wall 21 of the shield casing 2. The reduced section 12 has a tubular end 121 (FIG. 11) which may be expanded to comply with a flaring end 420 (FIG. 11) of the bore 42 thereby securing the guide post 1, the shield casing 2 and the housing 4 together (FIG. 6).

The housing 4 may comprise positioning pins 43 extending from the mounting face 40*b* thereof for properly positioning the plug connector 10 on a device or circuit board (not shown) to which the plug connector 10 is to be mounted.

Figure 7:
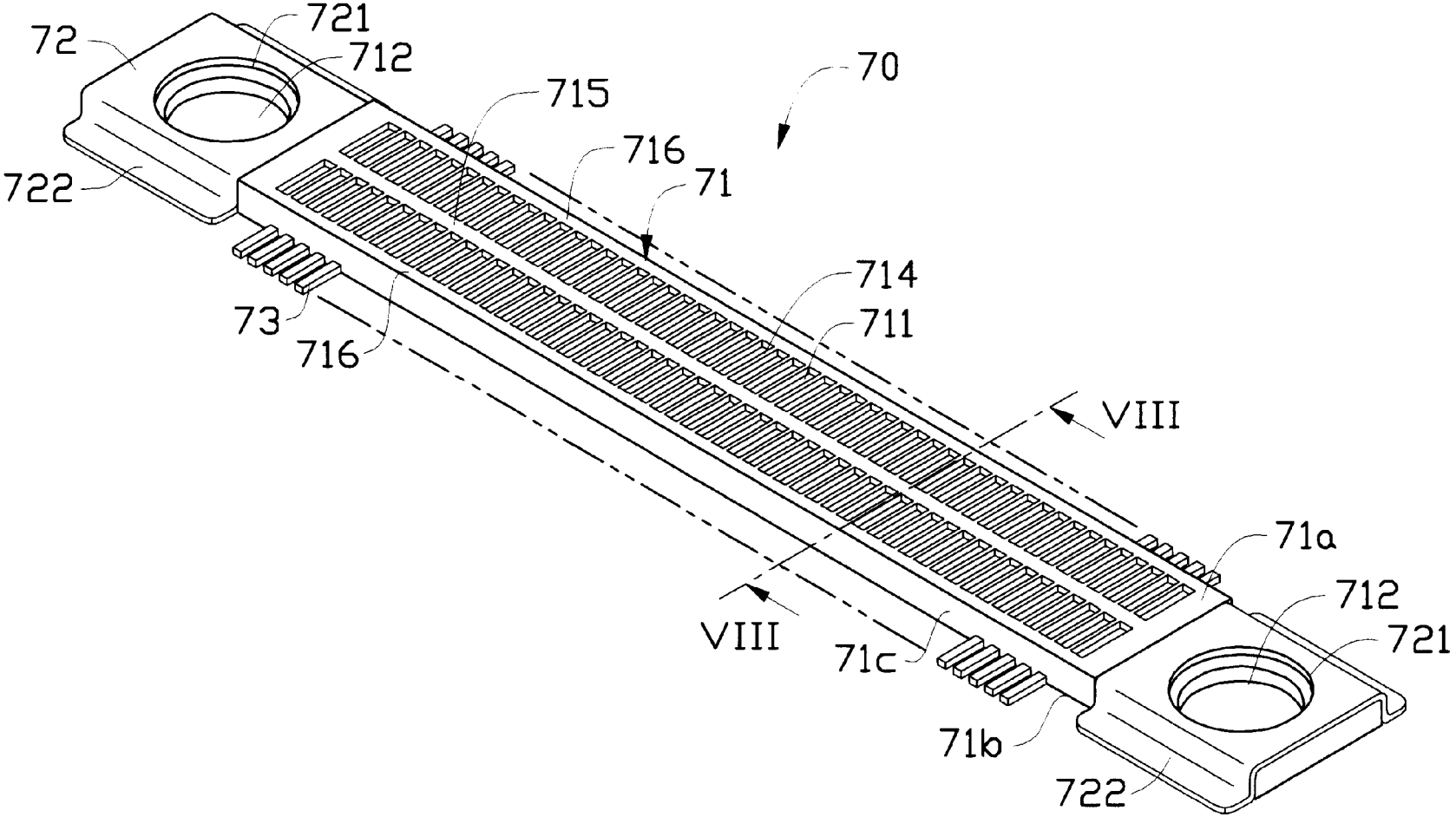
FIG. 7 s a perspective view of a socket connector of the electrical connection system of the present invention.

FIG. 7 shows the socket connector in accordance with the present invention, which is designated by reference numeral 70. The socket connector 70 comprises an elongate insulative housing 71 having a mating face 71*a* (also see FIG. 8) overlappingly engageable with the mating face 40*a* of the housing 4 of the plug connector 10 (FIG. 10) and a mounting face 71*b* opposite the mating face 71*a*.

Figure 8:
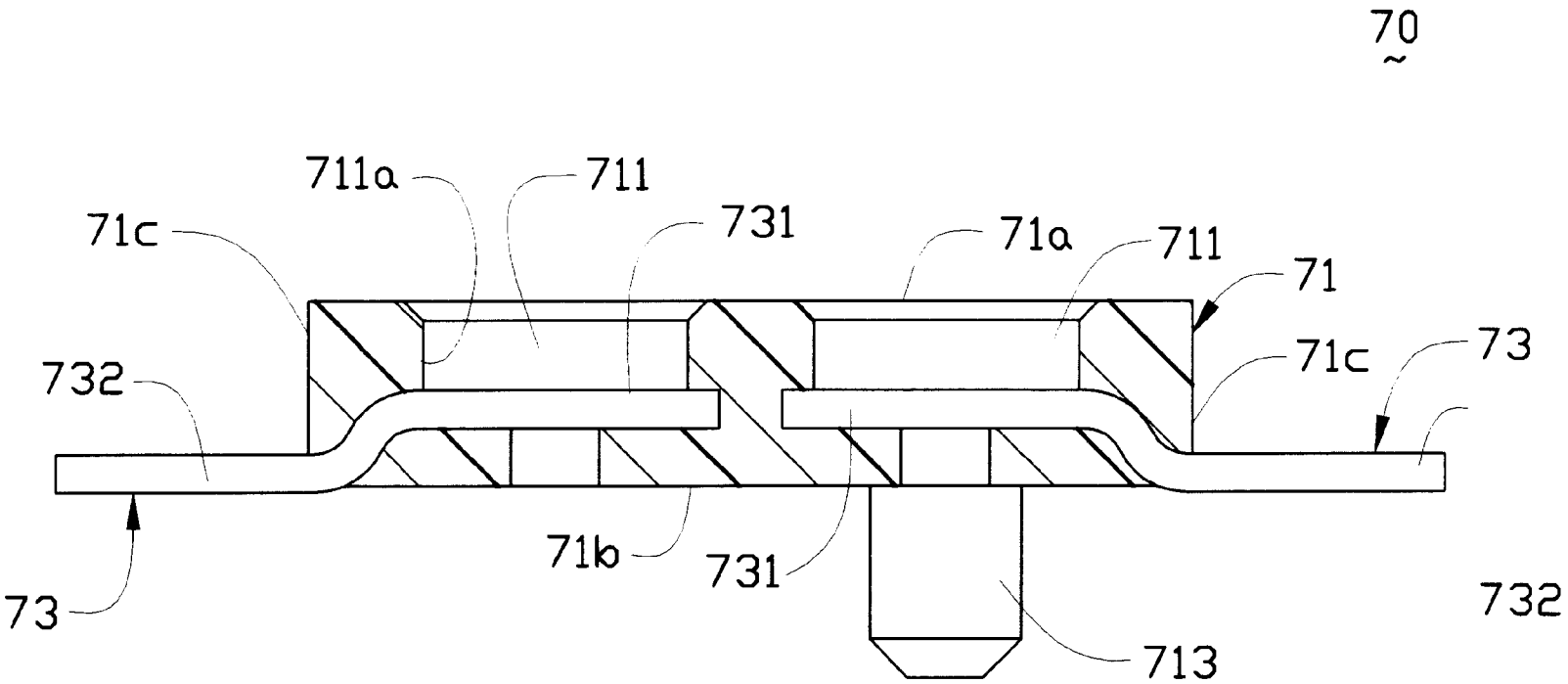
FIG. 8 is a cross-sectional view taken along line VIII—VIII of FIG. 7.

The housing 71 defines a plurality of passageways 711 extending from the mating face 71*a* thereof to a predetermined depth defining a bottom (not labeled). The passageways 711 are disposed in two rows along the lengthwise direction corresponding to the plug contact elements 5 for receiving the tip portions 532 therein. The passageways 711 of the same row are separated by partition walls 714, while the two rows are separated by an internal wall 715 and bound by two side walls 716 of the housing 71. The internal wall 715 and the side walls 716 form end faces 711*a* of the passages 711 (FIG. 8).

A socket contact element 73 is fixed in the housing 71 of the socket connector 70 and associated with each of the passageways 711. The socket contact element 73 has a mating section 731 supported on the bottom of the passageway 711 and extending along a second axis which is substantially parallel to the mating face 71*a* (and normal to the depth of the passageway 711) and a mounting section 732 extending beyond a side wall 71*c* of the housing 71 and substantially coplanar with the mounting face 71*b* for surface-mounting to a device or a circuit board (not shown). If desired, the mounting section 732 may extend beyond the mounting face 71*b* rather than the side wall 71*c*.

The socket housing 71 further comprises positioning pins 713 formed on the mounting face 71*b* for properly positioning the socket connector 70 on a device or a circuit board (not shown).

Figure 10:
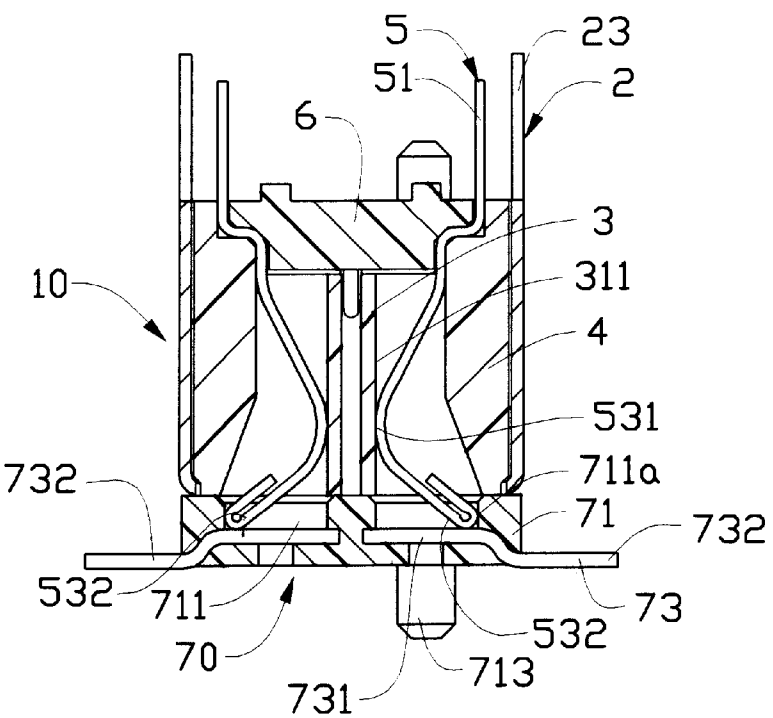
FIG. 10 is a cross-sectional view of the electrical connection system in accordance with the present invention wherein the plug and socket connectors are engaged with each other.

A post receiving hole 712 is defined in the socket housing 71 corresponding to and receiving the post body 11 of the guide post 1 fixed in the plug connector 10 for properly positioning the plug connector 10 with respect to the socket connector 70 as shown in FIG. 10. Preferably, a plate member 72 made from a metal sheet is attached to the portion of the socket housing 71 in which each post receiving hole 712 is defined. The plate member 72 defines an opening 721 aligned with the post receiving hole 712 for the reception of the guide post 1. The plate member 72 may have sideways extensions 722 for soldering to the device or circuit board to which the socket connector 70 is mounted.

The plate members 72 are engageable with the top wall 21 of the shield casing 2 of the plug connector 10 and an electrical connection may be formed therebetween for grounding purpose.

Figure 9:
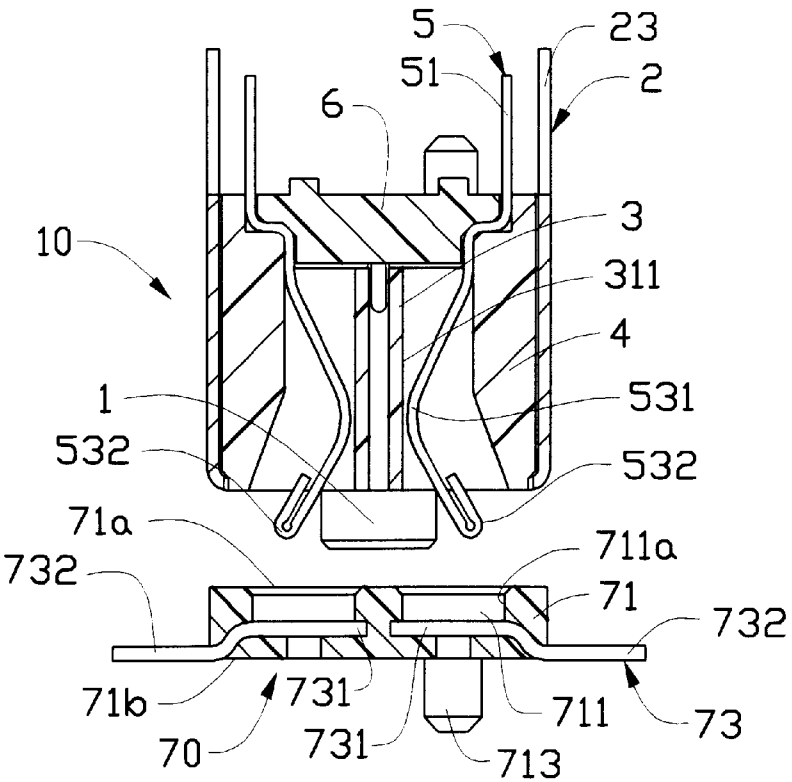
FIG. 9 is a cross-sectional view of the electrical connection system in accordance with the present invention wherein the plug connector is disengaged from the socket connector.

As shown in FIG. 9, when mating the plug connector 10 to the socket connector 70, the plug connector 10 is positioned with respect to the socket connector 70 with the mating faces 40*a*, 71 a thereof substantially parallel to and facing each other and the guide posts 1 of the plug connector 10 in alignment with the post receiving holes 712 of the socket connector 70. The plug and socket connectors 10, 70 are moved toward each other to insert the tip portions 532 of the plug contact elements 5 into the corresponding passageways 711 of the socket connector 70 and a further movement of the connectors 10, 70 toward each other brings the tip portions 532 of the plug contact elements 5 into engagement with the mating sections 731 of the socket contact elements 73 as shown in FIG. 10.

In accordance with the present invention, initially, only a point contact engagement is formed between the tip portion 532 of the plug contact element 5 and the mating section 731 of the socket contact element 73. Moving the connectors 10, 70 further toward each other leads to a deflection of the arcuate portions 531 of the plug contact elements 5 which positions the apexes of the arcuate portions 531 against the internal wall 3 of the plug housing 4 for supporting further deflection of the arcuate portions 531 caused by the movement of the connectors 10, 70 toward each other. The deflection of the arcuate portions 531 changes the inclination of the tip portion 532 with respect to the mating section 731 of the socket contact element 73 thereby changing the contact engagement from the point contact to a surface contact.

During the deflection of the arcuate portions 531, the tip portions 532 of the plug contact elements 5 slide on the corresponding mating sections 731 of the socket contact elements 73. The tip portions 532 may be dimensioned to engage with the end faces 711 a of the passageways 711, as shown in FIG. 10, which leads to a firmer engagement between the tip portions 532 of the plug contact elements 5 and the mating sections 731 of the socket contact elements 73.

Figure 11:
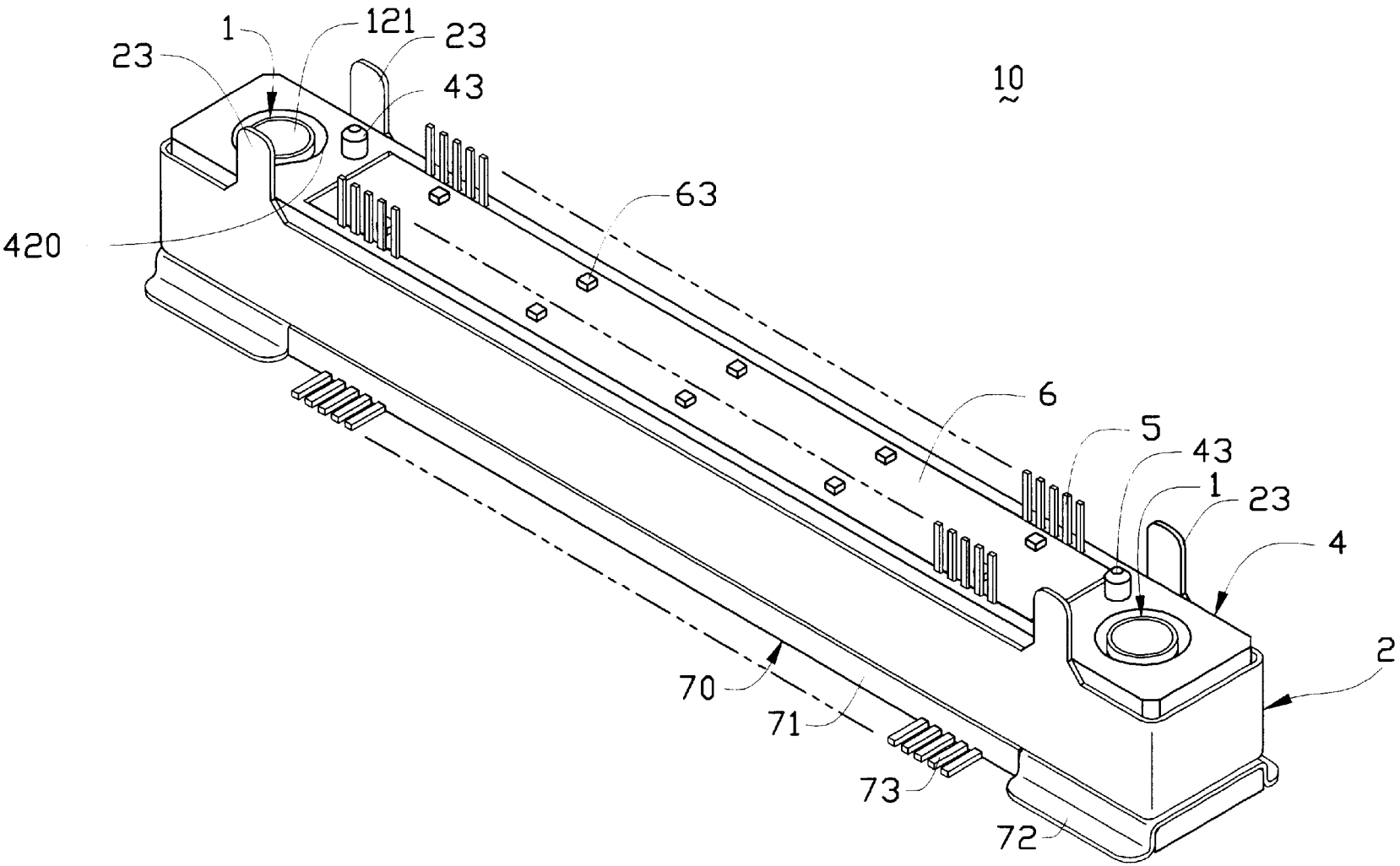
FIG. 11 is a perspective view of the electrical connection system wherein the plug and socket connectors are engaged with each other.

Eventually, the mating faces 40*a*, 71*a* of the connectors 10, 70 overlappingly engage with each other as shown in FIGS. 10 and 11 and securely position the tip portions 532 of the plug contact elements 5 against the mating sections 731 of the socket contact elements 73.

Figure 12B:
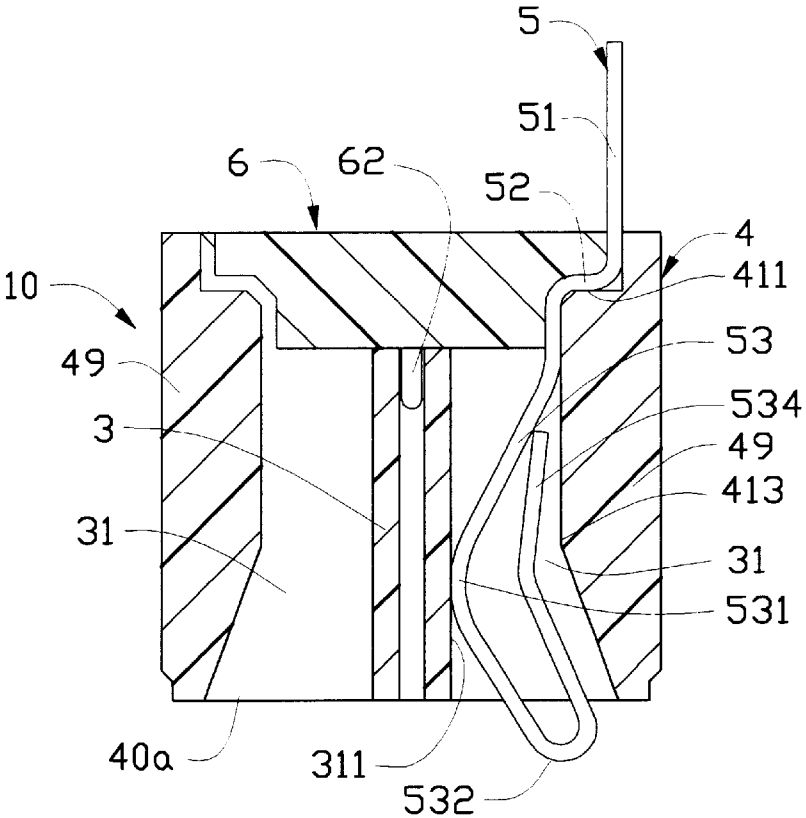
FIG. 12B is a cross-sectional view similar to FIG. 5, but showing a third embodiment of the plug connector of the present invention.
Figure 12A:
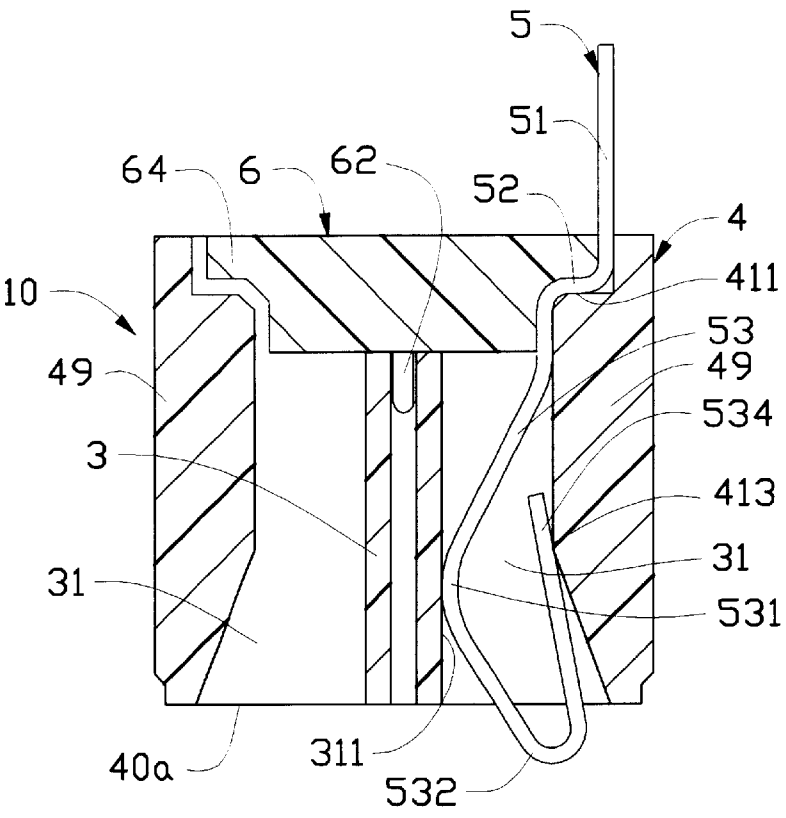
FIG. 12A is a cross-sectional view similar to FIG. 5, but showing a second embodiment of the plug connector of the present invention.

Although the present invention has been described with reference to preferred embodiments, it is apparent to those skilled in the art that a variety of modifications and changes may be made without departing from the scope of the present invention which is intended to be defined by the appended claims. For example, as shown in FIG. 12A, the mating section 53 of each plug contact element 5 can be provided with a backward bent extension 534 which engages with the inside face 413 of the side wall 49 of the housing 4 for more securely retaining the plug contact element 5 in position during the deflection of the arcuate section 531 thereof. In addition, as shown in FIG. 12B wherein a further modification of the plug contact element 5 is shown, the backward bent portion 534 is shaped in compliance with an inclined configuration of the inside face 413 of the side wall 49 of the housing 4 for more securely retaining the contact element 5. Obviously, these and other modification should be deemed within the scope of the present invention and be protected by the patent issued thereto.

What is claimed is:

1. An electrical connection system comprising a plug connector and a socket connector mated with each other, the plug connector comprising an insulative housing having a mating face defining a plurality of channels therein for each receiving plug contact elements, each plug contact element comprising a mating section extending along a first axis substantially normal to the mating face of the plug connector and having a tip portion extending beyond the mating face, the socket connector comprising an insulative housing having a mating face defining a plurality of passageways therein corresponding in position to the channels of the plug connector, each passageway having a socket contact element fixed therein, each socket contact element comprising a mating section located in the passageway and extending along a second axis substantially parallel to the mating face, wherein the mating faces of the plug and socket connectors are overlappingly engageable with each other to have the tip portions of the plug contact elements inserted into the passageways and engageable with the corresponding mating sections of the socket contact elements such that the tip portions exert an engaging force against the mating sections in a substantially perpendicular fashion and normal to the mating faces of the plug and socket connectors, and wherein the housing of the plug connector comprises a mounting face opposite the mating face thereof, a cavity being defined in the mounting face for receiving an insert therein, the cavity forming a shoulder on each of two side walls of the housing, the insert having a side flange extending over the shoulder, the plug contact element having a section supported on the shoulder and interposed between the shoulder and the side flange of the insert.

2. The electrical connection system as claimed in claim 1, wherein the plug connector comprises guide posts extending from the mating face thereof and wherein the socket connector defines post receiving holes in the mating face thereof for receiving the guide posts.

3. The electrical connection system as claimed in claim 1, wherein the plug connector comprises a shield member attached to the mating face thereof and the socket connector comprises a conductive member attached to the mating face thereof, the shield member of the plug connector electrically engaging with the conductive member of the socket connector when the mating faces engage with each other.

4. The electrical connection system as claimed in claim 1, wherein the insert has two opposite arms each having a barb engageable with an internal shoulder of the housing for securing the insert in the housing.

5. The electrical connection system as claimed in claim 1, wherein the insert comprises a plurality of positioning pins receivable in holes defined in the housing.

6. The electrical connection system as claimed in claim 1, wherein the mating section of each plug contact element comprises an arcuate portion supporting the tip portion at an inclined angle with respect to the first axis, the arcuate portion being deflectable when the tip portion engages with the mating section of the corresponding socket contact element thereby causing the tip portion to slide along the mating section of the socket contact element.

7. The electrical connection system as claimed in claim 6, wherein each passageway of the socket connector has an end face for engaging with the tip portion of the plug contact element to stop the sliding motion thereof.

8. The electrical connection system as claimed in claim 1, wherein the tip portion of the plug contact element comprises a backward bent portion extending back into the channel.

9. The electrical connection system as claimed in claim 8, wherein the backward bent portion has a configuration substantially corresponding to an inside face of the channel.

10. An connector comprising an insulative housing having a mating face defining a plurality of channels therein for each receiving a contact element, each contact element comprising a mating section extending along a first axis substantially normal to the mating face of the electrical connector, the mating section comprising an arcuate portion supporting a tip portion at an inclined angle with respect to the first axis, the tip portion extending beyond the mating face, the mating face being adapted to be positioned on a surface of an external device which comprises a plurality of conductive members formed on and overlapping the surface thereof, wherein a point contact engagement is initially formed between the tip portion of each contact element and the corresponding conductive member of the external device, the arcuate portion being deflectable to have the tip portion slide on the conductive member along a direction substantially parallel to the mating face of the insulative housing of the electrical connector to change the engagement therebetween from the initial point contact into a surface contact, and wherein the housing comprises a mounting face opposite the mating face, a cavity being defined in the mounting face for receiving an insert therein, the cavity forming a shoulder on each of two side walls of the housing, the insert having a side flange extending over the shoulder, the plug contact element having a section supported on the shoulder and interposed between the shoulder and the side flange of the insert.

11. The electrical connector as claimed in claim 10, wherein the housing comprises guide posts extending from the mating face and adapted to be inserted into holes defined in the external device.

12. The electrical connector as claimed in claim 10 further comprising a shield member fit over the housing.

13. The electrical connector as claimed in claim 11, wherein the insert has two opposite arms each having a barb engageable with an internal shoulder of the housing for securing the insert in the housing.

14. The electrical connector as claimed in claim 11, wherein the insert comprises a plurality of positioning pins receivable in holes defined in the housing.

15. The electrical connector as claimed in claim 10, wherein the tip portion of the contact element comprises a backward bent portion extending back into the channel.

16. The electrical connector as claimed in claim 15, wherein the backward bent portion has a configuration substantially corresponding to an inside face of the channel.

* * * * *